United States Patent [10]

Takanashi et al.

[11] 4,298,814

[45] Nov. 3, 1981

[54] DIRECTLY HEATED TYPE CATHODE ASSEMBLY

[75] Inventors: Yukio Takanashi, Hiratsuka; Toshiharu Higuchi, Yokohama, both of Japan

[73] Assignee: Tokyo Shibaura Denki Kabushiki Kaisha, Kawasaki, Japan

[21] Appl. No.: 85,317

[22] Filed: Oct. 16, 1979

[30] Foreign Application Priority Data

Oct. 17, 1978 [JP] Japan ..... 53-126823

[51] Int. Cl.[3] ..... H01J 1/46; H01J 21/10

[52] U.S. Cl. ..... 313/302; 313/270; 313/337; 313/409; 313/417

[58] Field of Search ..... 313/409, 417, 414, 337, 313/341, 270, 278, 302

[56] References Cited

U.S. PATENT DOCUMENTS

| | | | |
|---|---|---|---|
| 3,092,748 | 6/1963 | Dickson, Jr. et al. | 313/270 |
| 3,333,136 | 7/1967 | Coleman et al. | 313/341 X |
| 3,389,290 | 6/1968 | Yoshida et al. | 313/337 |
| 3,441,767 | 4/1969 | Kerstetter | 313/278 X |
| 3,444,416 | 5/1969 | Yoshida et al. | 313/270 |
| 3,465,195 | 9/1969 | Fuchs | 313/270 |
| 3,541,382 | 11/1970 | Takanashi et al. | 313/270 X |
| 3,633,062 | 1/1972 | Tamura | 313/341 |
| 3,681,643 | 8/1972 | Blatter | 313/337 |
| 3,878,424 | 4/1975 | Suganuma | 313/337 |

*Primary Examiner*—Saxfield Chatmon, Jr.

*Attorney, Agent, or Firm*—Cushman, Darby & Cushman

[57] ABSTRACT

A directly heated type cathode assembly comprises a ribbon filament to a substantially central portion of which an electron-emitting substance is attached through a metal plate, a first support member on which one end portion of the ribbon filament is fixed to support the ribbon filament, the first support member being electroconductive, a second support member for supporting that portion of the ribbon filament which is a little short of the other end of the ribbon filament, a conductive spring member fixed to the other end portion of the ribbon filament, and a conductive cathode cylinder supporting the first support member, second support member and spring member and having a base at the filament side, the base of the cylinder having at least one opening.

19 Claims, 17 Drawing Figures

DIRECTLY HEATED TYPE CATHODE ASSEMBLY

This invention relates to a directly heated type cathode assembly suited for use, for example, in three electron gun assemblies of a color picture tube.

In general, a color picture tube includes an in-line type of three electron guns. The three electron guns comprise a directly heated type cathode assembly and a plurality of grid electrodes.

FIG. 1 is a perspective view showing a directly heated type composite cathode assembly. The directly heated type composite cathode assembly comprises three sets of cathodes. An insulating base plate 1 is formed of ceramics etc. and three insertion holes 4 and three cutouts 5 are provided in the insulating base plate 1 to support first and second support members 2, 3. Stepped portions (not shown) are formed in the inner surfaces of the insertion holes 4 and cutouts 5 and a soldering glass is held in the stepped portions of the insertion holes 4 and cutouts 5 to fixedly bond first and second support members 2, 3 to the insulating base plate after the first and second support members have been inserted or fitted into the insertion holes 4 and cutouts 5. Cutting grooves 6, 7 of predetermined depths are provided one between the two of three cathodes. Each of pairs of first and second support members 2, 3 extends through the insulating base plate 1 such that the first and second support members in each pair are spaced a predetermined distance apart. The first support member 2 in each pair fixedly supports one end portion of a ribbon filament 10 to the substantially central portion of which an electron emissive substance 9 is attached through a metal plate 8. The second support member 3 in each pair supports that portion of the ribbon filament which is a little short of the other end of the ribbon filament. The other end portion of the ribbon filament extending away from the second support member 3 is resiliently fixed to the upper end portion of a spring member 11. The lower end portion of the spring member 11 is fixed to the second support member 3. The second support member 3 is rectangular in cross-section and provides a guide for a movable adjusting bar 12. In order to space a first grid (not shown) a predetermined distance away from the electron emissive substance 9 a movable adjusting bar 12 is abutted against the ribbon filament 10 for height adjustment. The first support member 2 at the fixed end side of the ribbon filament 10 is inserted through the insertion hole 4 of the insulating base plate 1 and fixedly bonded to the insertion hole 4. The second support member 3 at the movable and side of the ribbon filament 10 has the spring member 11 and movable adjusting rod 12 for adjusting a relation between the first grid electrode (not shown) and the electron emissive substance 9 and are fitted into the cutout of the insulating base plate 1. The spring member 11 is fixed to the second support member 3 to fixedly support one end portion of the filament and has such an elasticity as to permit the filament to be moved up and down to absorb a thermal expansion of the filament and adjust a distance between the first grid and the electron emissive substance when the filament 10 is heated upon a flow of electric current through the filament.

The electron emissive material 9 is made of (Ba, Sr, Ca) $CO_3$ and coated onto the upper surface of the metal plate 8 made of a Ni-based alloy including Mg, Si, W etc. As mentioned above, the movable adjusting rod 12 is adjusted or set such that the first grid electrode is spaced a predetermined distance away from the electron emissive material section. The movable adjusting rod 12 is preassembled between the first grid and the insulating base plate through a spacer, i.e., inserted into the support member 3 to permit an up and down movement along the support member 3 to adjust the position of the electron emissive material.

In the directly-heated type composite cathode structure as shown in FIG. 1, three directly heated type cathode assemblies are fixed in a single insulating base plate 1. When the distance between the respective electron emissive material and the first grid electrode is adjusted by the movable adjusting rod 12, there occurs "unevenness" in the vertical position of each movable adjusting rod 12. As a result, each filament 10 suffers a different tension and a "slack" or "burn-out" often occurs in the filament due to the heated filament. Further, since the three directly heated type cathode assemblies are fixed in the single insulating base plate, even if there are partial defects in the manufacturing step, the whole structure has to be discarded. It is impossible in the composite cathode structure to vary a distance between the respective electron emissive material sections of the cathode assemblies. If, therefore, a distance between the electron beam passing holes of the first grid electrodes varies dependent upon the type of the color picture tube, it is necessary to prepare a number of directly heated type composite cathode structures adapted for each type.

It is accordingly the object of this invention to provide a directly heated type cathode assembly which is simple in construction, capable of very easily adjusting the position of a filament and suffers no "slack" or "burn-out" resulting from a difference in a filament tension.

According to this invention there is provided a directly heated type cathode assembly comprising a ribbon filament to the substantially central portion of which an electron emitting substance is attached through a metal plate, a first support member for fixedly supporting one end portion of the ribbon filament and having an electroconductivity, a second support member for supporting that portion of the ribbon filament which is a little short of the other end of the ribbon filament, a conductive spring member fixed to the other end portion of the ribbon filament and having an electroconductivity, and a conductive cathode cylinder supporting one of the first support member, second support member and spring member and having a base at the side of the filament, and the base of the cathode cylinder having at least one opening.

This invention can be more fully understood from the following detailed description when taken in conjunction with the accompanying drawings, in which.

This invention will be explained below by using like reference numerals to designate like parts or elements throughout the specification.

Figure 2:
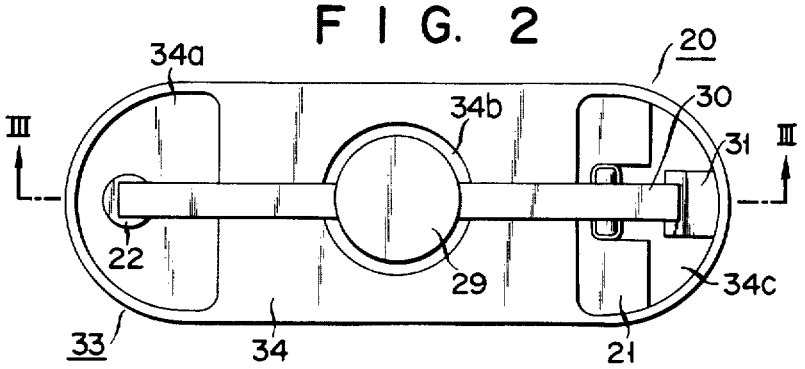
FIG. 2 is a plan view showing a directly heated type cathode assembly according to a first embodiment of this invention.
Figure 3:
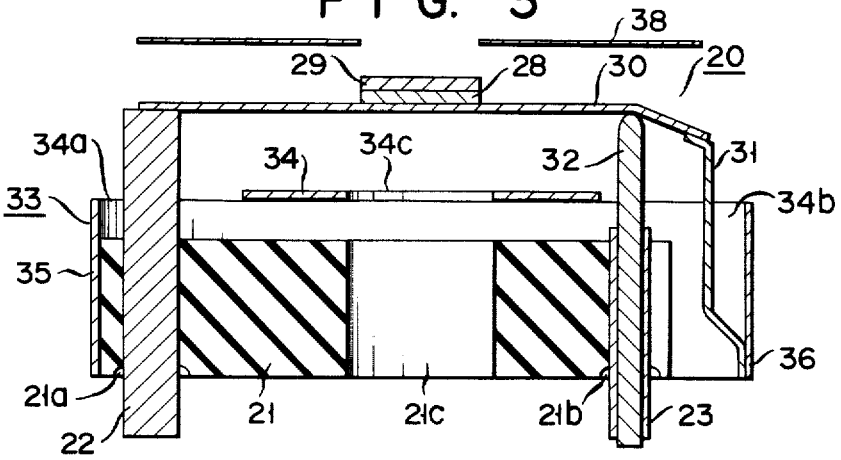
FIG. 3 is a cross-sectional view as taken along line III—III of FIG. 2.
Figure 4:
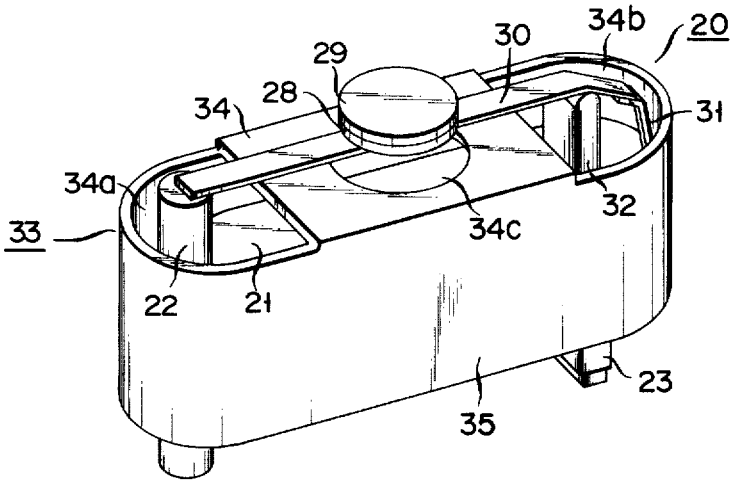
FIG. 4 is a perspective view showing the cathode assembly of FIG. 2.

In FIGS. 2 to 4, a directly heated type cathode assembly 20 has an insulating base plate 21 made of ceramics etc. The insulating base plate 21 has holes (for first and second support members 22 and 23) having recesses 21*a*, 21*b* for holding a solder glass, and a positioning opening 21*c* for positioning a later-described metal plate 28 when the lattes is attached to a ribbon filament 30. The first and second support members 22 and 23 are fixedly bonded to the insulating base plate 21 by the solder glass held in the recesses in the holes of the insulating base plate 21. The first support member 22 is electroconductive and fixedly supports one end portion of the ribbon filament 30 to the substantially central portion of which an electron emissive material 29 is attached through a metal plate 28. The second support member 23 supports that portion of the ribbon filament 30 which is a little short of the other end of the ribbon filament 30. The other end portion of the ribbon filament is fixed to the upper end portion of a spring member 31 which is welded to the portion of a later-described cathode cylinder 33 such that it is resiliently supported. The second support member 23 is hollow-cylindrical and provides a guide along which a movable adjusting rod 32 is moved into abutment with the ribbon filament to adjust a parallelism of the ribbon filament 30 with respect to a first grid 38.

The cathode cylinder 33 surrounds the side wall of the insulating base plate 21 and has a base 34 and a side wall 35. The insulating base plate 21 is fitted into the cathode cylinder 33. Openings 34*a*, 34*b* and 34*c* are provided in those portions of the base 34 of the cathode cylinder which correspond to the first support member 22, opening 21*c* in the insulating base plate 21 and second support member 23, respectively. The base 34 of the cathode cylinder acts as a shield plate for preventing an electroconductive flying material etc. produced during the use of the directly heated type cathode assembly 20 from being deposited onto the insulating base plate surface between the support members 22 and 23. One end portion of the spring member 31 is welded to the portion of the cathode cylinder 33 in a manner as mentioned above.

A color picture tube electron gun is assembled using three such directly heated type cathode assemblies as will be described below by referring to FIG. 5.

Figure 5:
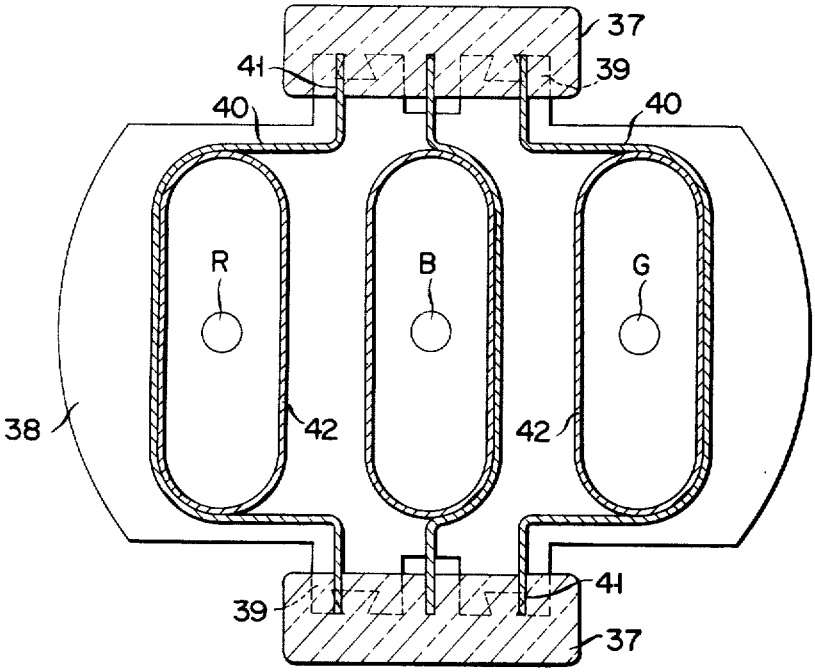
FIG. 5 is a cross-sectional view showing a structure incorporated into an electron gun assembly of a color picture tube.

In FIG. 5, a first grid electrode 38 having electron beam passing holes (R) (B) (G) in a line is attached through its attaching section 39 to a bead glass 37. The other electrodes are attached in the same manner. A cathode support plate 40 is also attached through its attaching portion to the bead glass 37. A cathode support plate 40 is attached through its attaching portion 41 to a bead glass 37. A cathode support cylinder 42 is attached to the cathode support plate 40. The directly heated type cathode assembly 20 as shown in FIGS. 2 to 4 is inserted in the cathode support cylinder. As in the case of a conventional indirectly heated type cathode assembly a distance between the electron beam passing portion of the first grid electrode 38 and the electron emissive material 29 is set at a desired value using a span setting device such as an air micrometer, and the cathode cylinder 33 is fitted into the cathode support cylinder 42 and welded thereto by a means such as welding. By so doing, an electron gun assembly is completed. The center of the electron beam passing hole of the first grid electrode 38 and the center of the electron emissive material 29 can be aligned with each other through utilization of the opening 34*c*.

Figure 1:
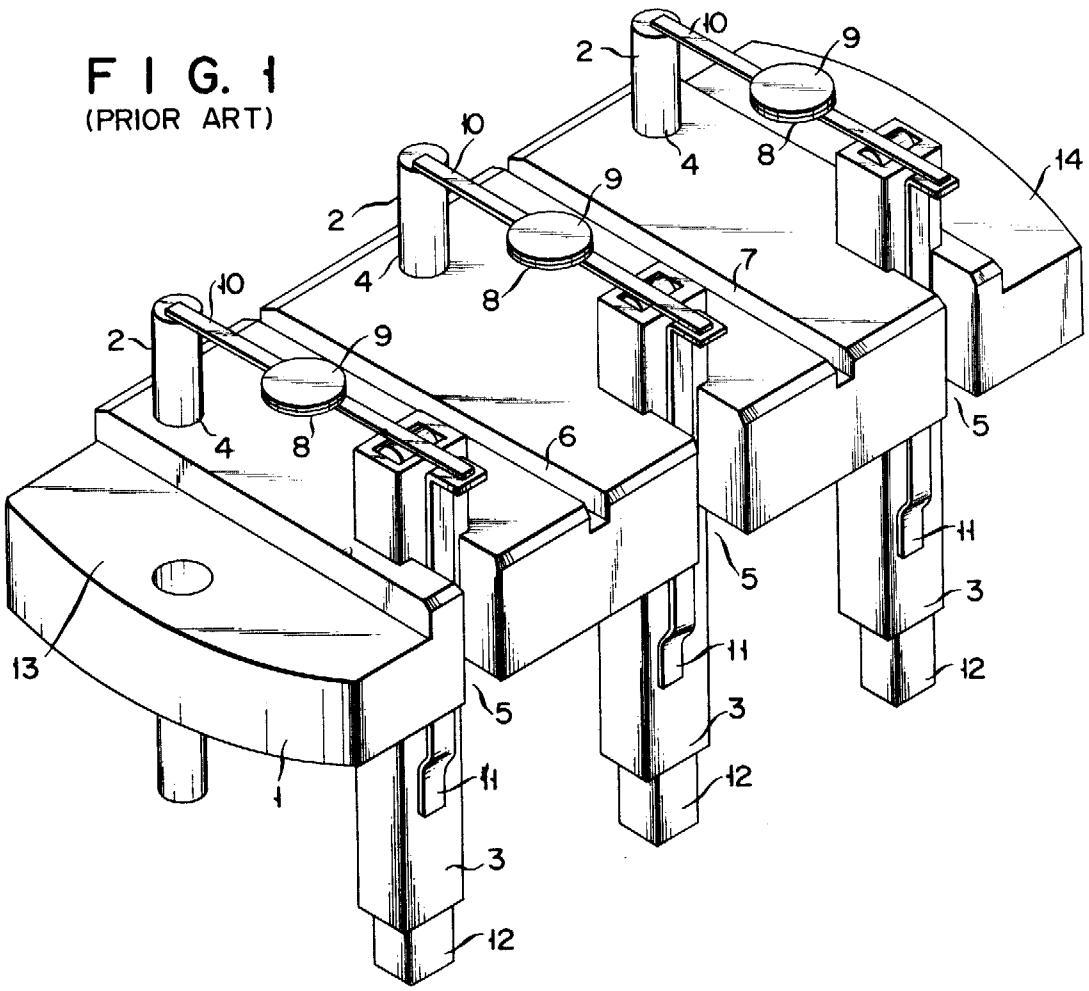
FIG. 1 (PRIOR ART)
FIG. 1 is a perspective view showing a conventional directly heated type cathode assembly.

If, as in the directly heated type composite cathode assembly of FIG. 1, a distance between the respective electron emissive material and the first grid electrode is adjusted by the movable adjusting rod 32, "unevenness" occurs in the vertical position of the adjusting rod and each filament suffers a different tension. As a result, the filament is slacked or burn out. According to this invention, these faults can be avoided and even if partial defects occur in the manufacturing step, only the defective parts can be thrown away. Even if a spacing between the electron beam passing holes of the first grid electrode differs dependent upon a wide neck portion or a narrow neck portion of the color picture tube, the same directly heated type cathode assembly can be used. Span setting can be effected by slightly varying a conventional indirectly heated type cathode assembly. Since the insulating support plate 21 can be made smaller, dimension errors hardly occur during the forming of ceramics parts. Furthermore, any undersired conductive material released from the electron emissive material etc. is shielded by the base surface of the cathode and prevented from being deposited onto the insulating base plate. An electrode is drawn out utilizing part of the cathode cylinder 33 and thus the effective length of the ribbon filament can be made longer.

Figure 6:
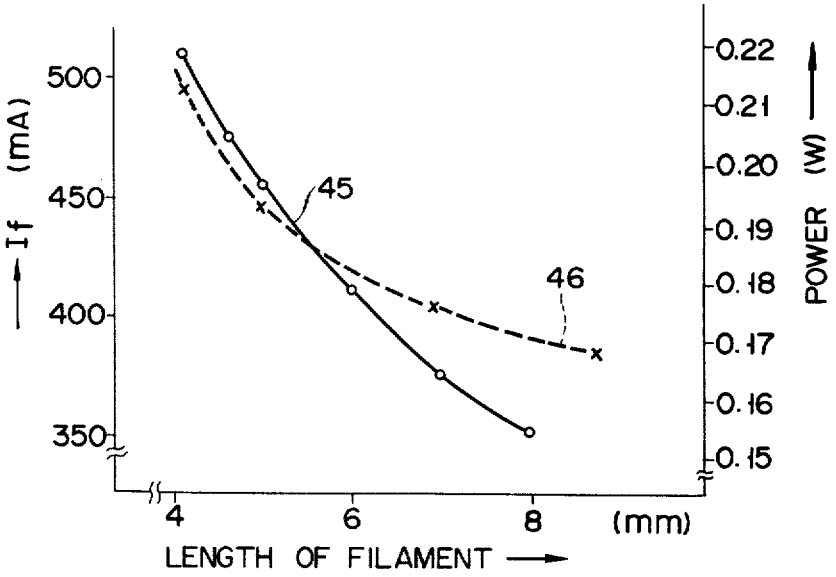
FIG. 6 is a graph showing a relation between a filament current and power in a cathode assembly and a filament length.

In the directly heated type cathode, a heat conduction loss reaches the electron emissive material portion by a filament heat conduction. However, the heat conduction loss can be reduced by making the effective length of the filament longer. With the temperature of the electron emissive material constant, the heating current can be decreased. FIG. 6 shows this relation as plotted with the heating current $I_f$ as the ordinate and the filament length as the abscissa. If in this case the effective length of the practical filament is 6 mm and the maximum temperature portion of the filament is made at 900° C., required electric current can be 23% reduced as indicated by the curve 45 by making the filament length 2 mm as long. The filament material as used in the directly heated type cathode assembly has a high specific resistance at normal temperature. For example, a 70% Ni-30% W alloy has a specific resistance of 96 μΩcm at 20° C. and 114 μΩcm at 900° C. and the supply voltage can be made higher by making the effective length of the filament longer. By so doing, the supply voltage is made higher and the electric current smaller. Since the directly heated type cathode has a smaller operating voltage of, for example, 0.6 V, it is liable to be influence by a contact resistance of a stem pin and socket. The structure of this invention can make the effective length of the filament longer, the electric current smaller and the voltage higher (for example, 0.8 V). Therefore, the structure is less influenced by the contact resistance of the stem pin and socket than the conventional structure. As a result, it is possible to provide a directly heated cathode assembly of high quality.

FIG. 6 shows a relation of the heater electric power to the filament length when the cathode is made at the same temperature with the filament length variable. As indicated by the curve 46 in FIG. 6 required electric power is smaller for a filament length of 8 mm than for a filament length of 8 mm. The reason for this is that the shorter the filament length the greater the heat conduction loss from the filament end. It, as mentioned above, the practical length of the practical filament is 6 mm and the maximum temperature portion is made at 900° C., required electric power can be 10% reduced by making the filament length 2 mm as longer. Thus, it is possible to provide a directly heated type cathode assembly having a smaller power consumption.

Figure 7:
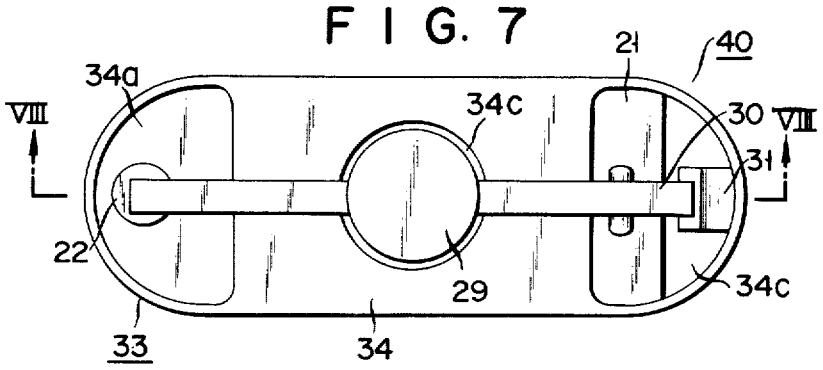
FIG. 7 is a plan view showing a directly-heated type cathode assembly according to a second embodiment of this invention.
Figure 8:
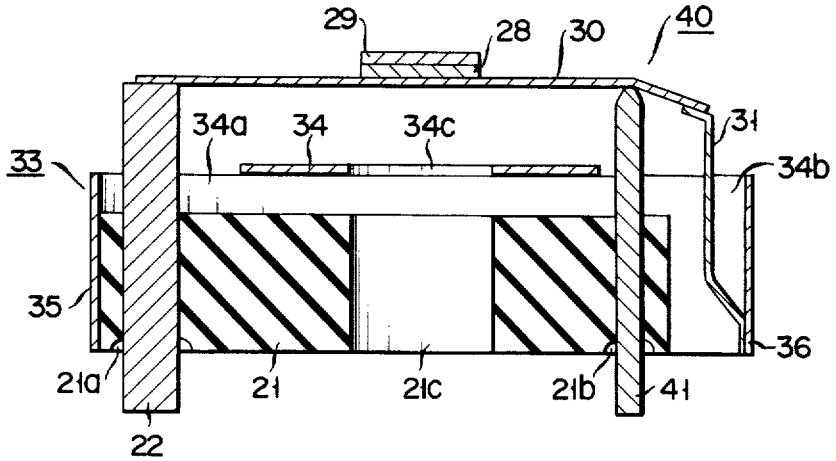
FIG. 8 is a cross-sectional view as taken along VIII—VIII of FIG. 7.

A directly heated type cathode assembly according to a second embodiment of this invention will be explained below by referring to FIGS. 7 and 8.

In the directly heated type cathode assembly of FIGS. 2 to 4 a ribbon filament 30 is stretched by a spring member 31 and a movable adjusting rod 32 is disposed to permit the parallelism of the ribbon filament to be adjusted with respect to the first grid. In this embodiment the movable adjusting rod is omitted and a second support member is directly attached to an insulating support plate 21. By so doing, the directly heated type cathode assembly 40 is simpler in construction, lower in manufacturing cost and lesser in parts required.

A directly-heated type cathode assembly according to the third embodiment of this invention will be explained below by referring to FIGS. 9 to 11.

Figure 9:
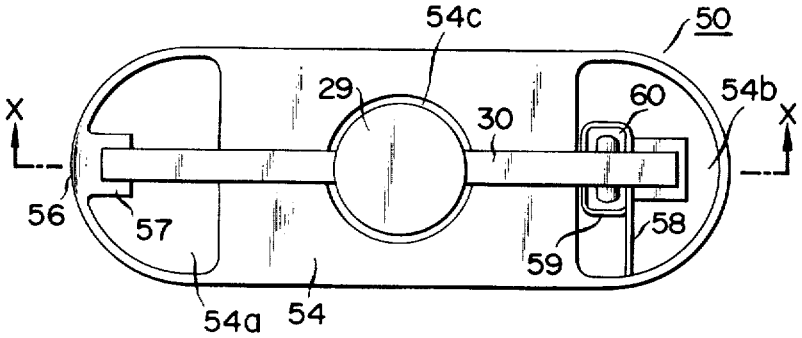
FIG. 9 is a plan view showing a directly heated type cathode assembly according to a third embodiment of this invention.
Figure 10:
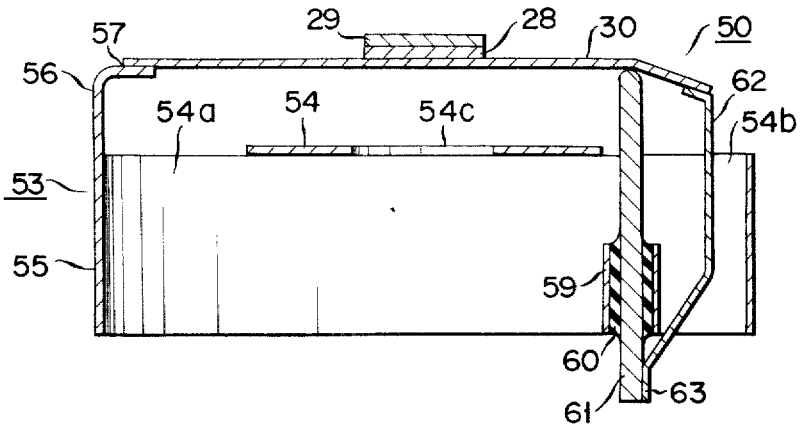
FIG. 10 is a cross-sectional view as taken along line X—X of FIG. 9.
Figure 11:
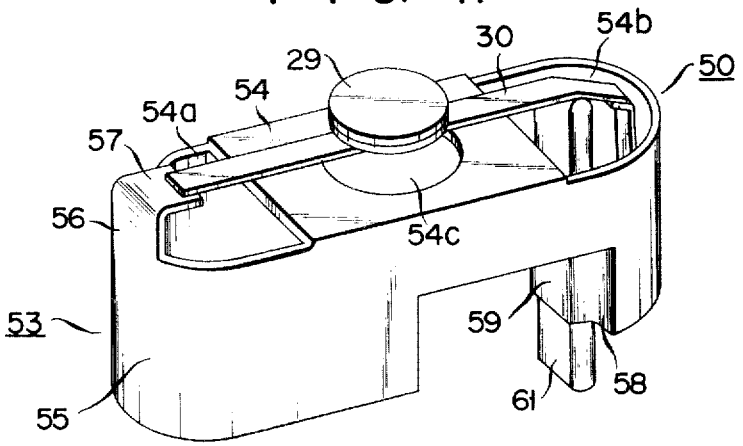
FIG. 11 is a perspective view showing a cathode assembly of FIG. 9.

In the directly-heated type cathode assembly of FIGS. 9 to 11 an extension 56 is provided on one end wall of a cathode cylinder 53 and a ribbon-like filament 30 is bonded to the first support member 57 i.e. the end portion of the extension. A cutout is provided at the portion of the open end side of the cathode cylinder 53 to provide an inwardly bent flap portion 58. The flap portion 58 is formed in a cylindrical configuration 59 such that a second support member 61 is attached to the flap portion 58 through an insulating material 60 to such as a glass or glass ceramics. A spring member 62 is welded to the second support member 61. The extension 56 and flap portion 58 are provided instead of the insulating base plate 21 and first electroconductive support member 22 as shown in the first embodiment. 54, **54*a*, 54*b* and 54*c* correspond to 34, 34*a*, 34*b* and 34*c***, respectively.

By so doing, the insulating base plate 21, first electroconductive support member 22 and bonding glass parts can be omitted, thereby lowering a manufacturing cost.

As a modified form, the support member 22 as shown in the first and second embodiment may be bonded to the side wall of the cathode cylinder instead of providing the extension 56.

Figure 12:
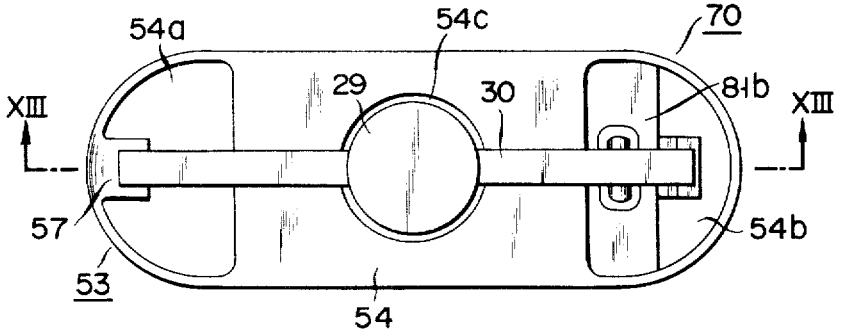
FIG. 12 is a plan view showing a directly heated type cathode assembly according to a fourth embodiment of this invention.
Figure 13:
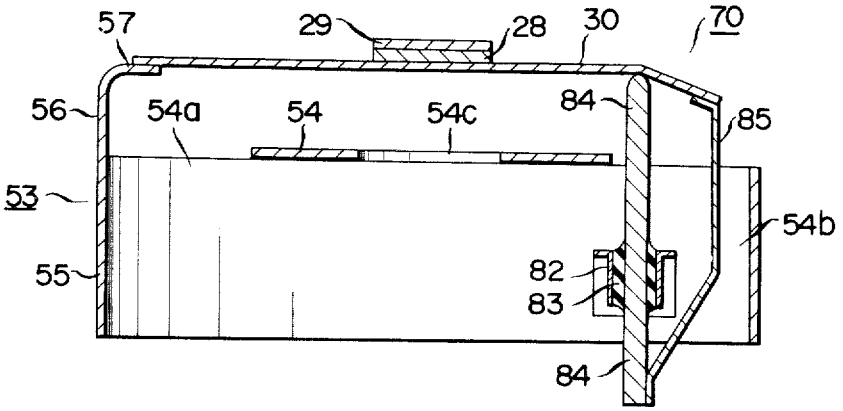
FIG. 13 is a cross-sectional view as taken along line XIII—XIII of FIG. 12.
Figure 14:
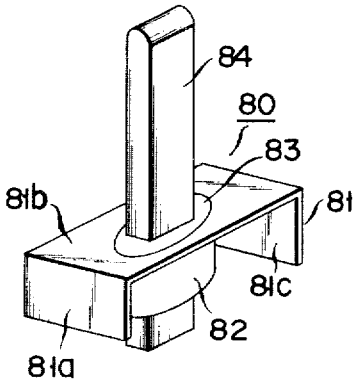
FIG. 14 is a perspective view showing a support structure of the cathode assembly.

A fourth embodiment of this invention will be explained below by referring to FIGS. 12 to 14.

Figure 15:
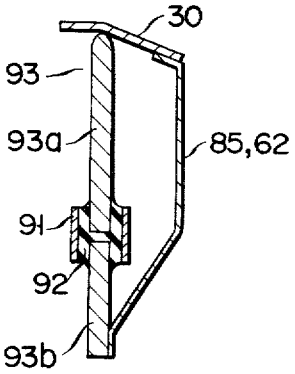
FIG. 15 is a cross-sectional view showing a second support member of a directly heated type cathode assembly according to a fifth embodiment of this invention.
Figure 16:
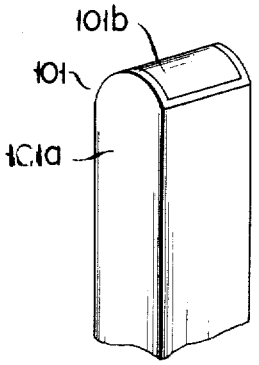
FIG. 16 is a perspective view showing a forward end portion of a second support member of FIG. 15.

In the fourth embodiment no flap portion as shown in the third embodiment is provided. A support structure 80 as shown in FIG. 14 is disposed within the directly-heated type cathode assembly. A cylindrical member 82 is formed on the central portion of a substantially U-shaped support fitting. A second support member 84 is attached to the cylindrical member 82 through an insulating material 83 such as a glass or glass ceramics and one end portion of a spring member 85 is bonded to the support member 84. Both side surface sections **81*a* and 81*b* of the support fitting 81 of the support structure is fixed to a side wall 55 of the cathode cylinder. In this way, a directly-heated type cathode assembly 70 is completed. The tension of the filament 30 can be freely varied by attaching the side surface sections 81*a* and 81*b* of the support fitting 81 at a predetermined position to the side wall 55 of the cathode cylinder 53. FIG. 15 shows a second support member as applied to a fifth embodiment of this invention. In this modification, the other parts or elements are substantially the same as those of the third and fourth embodiments. That is, a second support member 93 is supported through an insulating material 92 to a cylinder 91 which is substantially to the cylindrical configuration 59 (third embodiment) formed integral with a bottomed cathode cylinder or the cylindrical member 82 (fourth embodiment) formed separately as the cathode cylinder. The second support member 93 comprises a filament support member 93*a* and spring support member 93*b* which are mutually insulated from each other within the insulating material 92. A filament current flows through a first support member 57 and is taken out of the spring support member 93*b* through the spring member 62 or 85**.

In the first to fifth embodiment, the second support member may comprise a 2-layer unit having a Cr-containing metal as a core **101*a* and an outer cladding 101*b* as an outer layer which is made of Kover etc. and shows a good adhesivity to the glass. The portion of the core 101*a* which abuts against the ribbon filament is exposed and oxidized to provide a good insulating film. By so doing, it is possible to provide a good insulation between the ribbon filament and the second support member. The reason why in the third and fifth embodiments the insulating base plate is unnecessary is that no higher insulation is required between the cathode cylinder 53 (one electrode of the filament) and the spring member 62 or 85 (the other electrode of the filament). It will be sufficient if there is a withstand voltage with respect to about 1Ω to 1.5Ω, a resistance across the filament 30**. It will be sufficient if the insulating material has an insulating property as possessed by a normal glass.

As a result, component parts can be omitted to a maximum possible extent and a directly headed type cathode assembly can be manufactured on a paying basis and accurately mass-produced at a lesser number of steps. In the third and fourth embodiments the first supporting member is integrally connected to the cathode cylinder (33, 53) or the second support member and spring member may be integrally connected to the other end wall of the cathode cylinder. In the third and fourth embodiments the second support member and spring member are supported through the insulating material without using the insulating base plate 21. Even if, on the other hand, the second support member and spring member are integrally connected to the other end wall of the cathode cylinder, the insulating support plate as shown in the first and second embodiments can be omitted by supporting the first support member through the insulating material.

Figure 17:
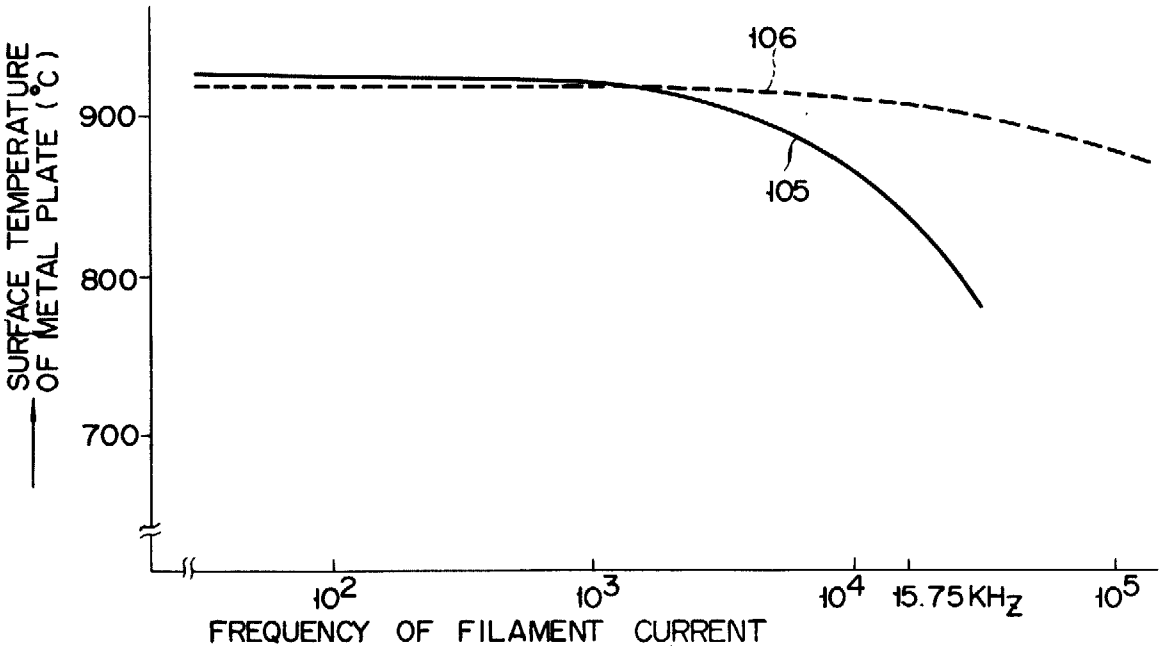
FIG. 17 is a graph showing a relation of a filament power current frequency to a surface temperature of a metal plate.

In the third to fifth embodiments the dependancy of the surface temperature of the metal plate 28 upon the filament power current frequency is smaller as shown in FIG. 17 than in the first and second embodiments. FIG. 17 shows a result of measurement of the surface temperature of the metal plate 28 when the frequency is varied with the filament power supply voltage fixed. In FIG. 17, the solid line 105 corresponds to the first embodiment and the broken line 106 corresponds to the third embodiment. As will be evident from FIG. 17, the surface temperature of the metal plate 28 is abruptly lowered in the first embodiment as the frequency exceeds $5\times10^3$ Hz, but in the third embodiment is not appreciably lowered up to $10^5$ Hz. Note that the second embodiment shows the same tendency as the first embodiment and that the fourth and fifth embodiments shows the same tendency as the third embodiment.

In a television apparatus, in general, use in made as a filament power supply of a low-voltage tap (15.75 KHz) of a flyback transformer or a low-voltage converted from a commercial power supply voltage (50 or 60 Hz). The third to fifth embodiments having a lower frequency dependency can be applied to a television apparatus designed such that a low-voltage tap of the flyback transformer or a low-voltage converted from a commercial power supply voltage is used as a filament power supply.

In the first to fifth embodiments use is made of a bottomed cathode cylinder substantially elliptical in cross-section which has three openings at the base, but this invention is not restricted thereto. In the embodiment in which one end portion of the ribbon filament is directly supported on the cathode cylinder, it is not necessary to provide openings 34*a*, 54*a*. A simple cathode cylinder may be used instead of the bottomed cathode cylinder. A flat plate may be bent in a substantially U or L shape to provide a support section for the ribbon filament, as well as a support section, though through an insulating material. In this case, the cathode support plate 40 and cathode support cylinder 42 may be changed.

The directly-heated type cathode assembly of this invention is simpler in construction and easier in positional alignment than the conventional directly heated type composite cathode structure, and very high in industrial value.

What we claim is:

1. An electron gun assembly comprising three directly heated type cathode assemblies constructed independently of each other, grid electrodes each having three electron beam passing holes, support rods for supporting the cathode assemblies and grid electrodes, and cathode support means for attaching the cathode assemblies to the support rods, each of the cathode assemblies comprising:

a cathode cylinder;

a first electroconductive support member supported by the cathode cylinder;

a conductive spring member supported by the cathode cylinder;

a ribbon filament supported at a first end by the first electroconductive support member and at a second end thereof by the conductive spring member;

a metal plate fixed to a central portion of the filament;

an electron-emitting substance attached to the metal plate; and a second support member, supported by the cathode cylinder, for supporting a portion of the filament between the metal plate and the conductive spring member, the cathode cylinder being attached to the cathode support means so as to be fixed within the electron gun assembly.

2. A directly heated type cathode assembly according to claim 1 in which said first support member and second support member are supported in an insulating base plate which is fitted in the cathode cylinder, and said spring member is directly supported to make an electrical connection with the cathode cylinder.

3. A directly heated type cathode assembly according to claim 1 in which said first support member is provided integral with the cathode cylinder, said second support member is supported through an insulating material by a cylindrical support which is formed integral with the cathode cylinder and inside of the cathode cylinder, and said spring member has its lower end portion fixedly supported on said second support member.

4. A directly heated type cathode assembly according to claim 1 in which said first support member is formed integral with said cathode cylinder, said second support member is supported through an insulating material by a support structure fixed to the cathode cylinder, and said spring member has its base end portion fixedly supported on the second support member.

5. A directly heated type cathode assembly according to claim 1 in which said second support member is fixed through an insulating material in a cylindrical support formed integral with the cathode cylinder or in a support structure fixed in the cathode cylinder, and comprises a filament support member and a spring support member which are supported in the insulating material such that they are insulated from each other.

6. A directly heated type cathode assembly according to claims 1, 2, 3, 4 or 5 in which said second support member comprises a core portion made of a chromium alloy and a clad portion made of a material having a good adhesivity to glass, and that forward end portion of said second support member which supports the filament is uncladded to provide an oxidized core portion.

7. A directly heated type cathode assembly according to claim 1 in which said conductive cathode cylinder directly supporting one of the first support member, second support member and spring member to make an electrical connection thereto, and indirectly supporting the other two members through an insulating material.

8. An electron gun assembly according to claim 1, wherein the cathode support means comprises: a cathode support plate attached to the support rods and a cathode support cylinder attached to the cathode support plate, the cathode cylinder being inserted into the cathode support cylinder and fixed thereto.

9. The electron gun assembly according to claim 2, 3 or 4 in which the cathode cylinder comprises a base at the filament side thereof, for preventing deposition of a conductive flying material from the electron emitting substance.

10. An electron gun assembly according to claim 9 in which the base has an opening therein.

11. An electron gun assembly according to claim 1 further including an insulated base plate wherein the first and second support members are supported, the base plate being fitted within the cathode cylinder.

12. An electron gun assembly according to claim 1 wherein (a) the first support member is integral with the cathode cylinder (b) the second support member is supported through an insulating material by a cylindrical support which is formed integral with the cathode cylinder and which is within the cathode cylinder and (c) the spring member has a lower portion thereof fixedly supported on the second support member.

13. An electron gun assembly according to claim 1 wherein (a) the first support member is formed integral with the cathode cylinder, (b) the second support member is supported through an insulating material by a support structure fixed to the cathode cylinder, and (c) the spring member has a base end portion fixedly supported on the second support member.

14. An electron gun assembly according to claim 1 wherein the second support member is fixed through an insulating material in a cylindrical support formed integral with the cathode cylinder or in a support structure fixed in the cathode cylinder and comprises a filament support member and spring support member which are supported in the insulating material such that they are insulated from one another.

15. An electron gun assembly according to claim 1, 8, 11, 12, 13 or 14 wherein the second support member comprises a core portion made of a material having adhesivity to glass and wherein a forward end portion of the second support member, supporting the filament, is uncladded to provide an oxidized core portion.

16. An electron gun assembly according to claim 9 wherein the second support member comprises a core portion made of a material having adhesivity to glass and wherein a forward end portion of the second support member, supporting the filament, is uncladded to provide an oxidized core portion.

17. An electron gun assembly to claim 10 wherein the second support member comprises a core portion made of a material having adhesivity to glass and wherein a forward end portion of the second support member, supporting the filament, is uncladded to provide an oxidized core portion.

18. An electron gun assembly according to claim 1 wherein the cathode cylinder directly supports one of the first and second support members and spring member so as to make an electrical connection therewith and indirectly supports the other two through an insulating material.

19. A directly heated type cathode assembly for connection into an electron gun assembly including more than one such cathode assembly, comprising:

a cathode cylinder;

a first electroconductive support member supported by the cathode cylinder;

a conductive spring member supported by the cathode cylinder;

a ribbon filament supported at a first end by the first electroconductive support member and at a second end thereof by the conductive spring member;

a metal plate fixed to a central portion of the filament;

an electron-emitting substance attached to the metal plate; and a second support member, supported by the cathode cylinder, for supporting a portion of the filament between the metal plate and the conductive spring member, the cathode cylinder being adapted for connection within the electron gun assembly.

* * * * *